United States Patent [19]

Theurer

[11] 4,063,516

[45] Dec. 20, 1977

[54] TRACK SURFACING

[75] Inventor: Josef Theurer, Vienna, Austria

[73] Assignee: Franz Plasser Bahnbaumaschinen-Industriegesellschaft m.b.H., Vienna, Austria

[21] Appl. No.: 684,280

[22] Filed: May 7, 1976

[30] Foreign Application Priority Data

June 13, 1975 Austria ..... 4568/75

[51] Int. Cl.[2] ..... E01B 27/02

[52] U.S. Cl. ..... 104/12; 37/104

[58] Field of Search ..... 104/2, 7 R, 7 A, 7 B, 104/10, 12; 171/16; 37/104, 105, 106, 107

[56] References Cited

U.S. PATENT DOCUMENTS

| | | | |
|---|---|---|---|
| 967,033 | 8/1910 | McClellan | 104/12 |
| 2,107,639 | 2/1938 | Madison | 104/12 |
| 3,292,558 | 12/1966 | Oville | 104/12 X |
| 3,457,660 | 7/1969 | Speno | 37/105 |
| 3,826,195 | 7/1974 | Bucksch | 104/2 |

*Primary Examiner*—Robert J. Spar
*Assistant Examiner*—Randolph A. Reese
*Attorney, Agent, or Firm*—Kurt Kelman

[57] ABSTRACT

A mobile track tamper comprises vibratory tamping tools for tamping ballast under the track ties and ballast removing tools associated with the tamping tools for removing at least a portion of the ballast from a region below the ties intermediate the track rails. The track is surfaced by tamping ballast at the points of intersection between the ties and rails and removing the ballast from between the points of intersection.

21 Claims, 12 Drawing Figures

TRACK SURFACING

The present invention relates to improvement in track surfacing and a mobile machine for tamping ballast under ties supporting rails of a track by means of vibratory tamping tools which may be reciprocable towards and away from respective ones of the ties.

Mobile tamping machines with pairs of reciprocating vibratory tamping tools associated with each track rail for immersion of a respective ballast tamping tool alongside the longitudinal edges of a respective tie, with the tie between the pairs of tools and the tools arranged to reciprocate towards and away from the longitudinal tie edges are well known. The vibration and reciprocation of the tamping tools causes the ballast under the ties to be compacted, particularly at the intersections between the rails and ties, so that a solid support is formed at these intersections for the track resting on the ballast.

It has also been proposed to provide ballast tamping machines with tamping tools arranged for immersion in the cribs between two adjacent ties and for compacting the ballast, particularly in the region of the crib. If a considerable vertical thrust is applied to the tools, at least some of the ballast will be pressed from the crib under the adjacent ties. Machines of this type have the disadvantage that the strong vertical thrust will force the ballast under the ties not only in the regions of the intersections of ties and rails but also in the region intermediate the track rails, which will compact the ballast in the intermediate region, too. This, however, will cause the ties to ride on the ballast, i.e. the ballast support for the center of the ties will eventually be higher than the ballast support at the intersections because the latter will be depressed by the repeated loads of trains passing over the track. Therefore, after a while, the track ties will begin to pivot about their center. This will not only cause rapid deterioration of the ties but will also reduce the quality of the track surface. If concrete ties are used, the resultant flexing loads may cause the ties to break and thus seriously endanger the safety of the track.

It is the primary object of this invention to avoid excess compacting of ballast under the ties at their centers so as to reduce or even eliminate riding of the ties.

The above and other objects are accomplished in accordance with the invention by combining with the vibratory ballast tamping tools means for removing at least a portion of the ballast from a region below the ties intermediate the track rails. The ballast removing means includes ballast removing tools associated with the tamping tools.

With such a mobile tamping machine, the density of the ballast in the intermediate region may be reduced or practically all of the ballast may even be removed therefrom to produce a cavity under the ties between the rails so that each tie constitutes a statically defined system consisting of a carrier (the tie) supported at two points (intersection of tie and rails). Furthermore, when the corrected track settles under the load of train traffic, the center region of the ballast under the ties cannot be more densely compacted than the two ballast track support regions under the rails. The statically defined positioning of the ties permits the same to remain substantially unchanged in their position for long periods of time so that the corrected position of the track will be maintained for much longer than has heretofore been possible. This reduces wear not only on the track components, including ties, rails and rail fastening elements, but also on the rolling stock, including locomotives and railroad cars. In addition, the ballast removed from the center region of the ties can be used for increasing the density of the ballast under the rails, which improves the solidity of the track support.

Accordingly, the present invention provides a method of surfacing a track by tamping ballast under the ties at the points of intersection between the ties and rails, and removing ballast from underneath the ties between the points of intersection no later than the tamping of the ballast.

The invention has proved to be of particular advantage when it is used before dynamic track stabilization, in which a newly corrected track is settled by simultaneous application of horizontal and vertical vibratory forces, since it will prevent the formation of densified ballast zones under the ties in the centers thereof in the first place.

The above and other objects, advantages and features of the present invention will become more apparent from the following detailed description of certain now preferred embodiments thereof, taken in conjunction with the accompanying schematic drawing wherein FIG. 1 is a partial side elevational view of a combined mobile track tamping, leveling and lining machine incorporating apparatus for the dynamic stabilization of the track as well as one embodiment of the ballast removing means of this invention;

Figures 1, 2, 3, 4, 5, 6, 7, 8:
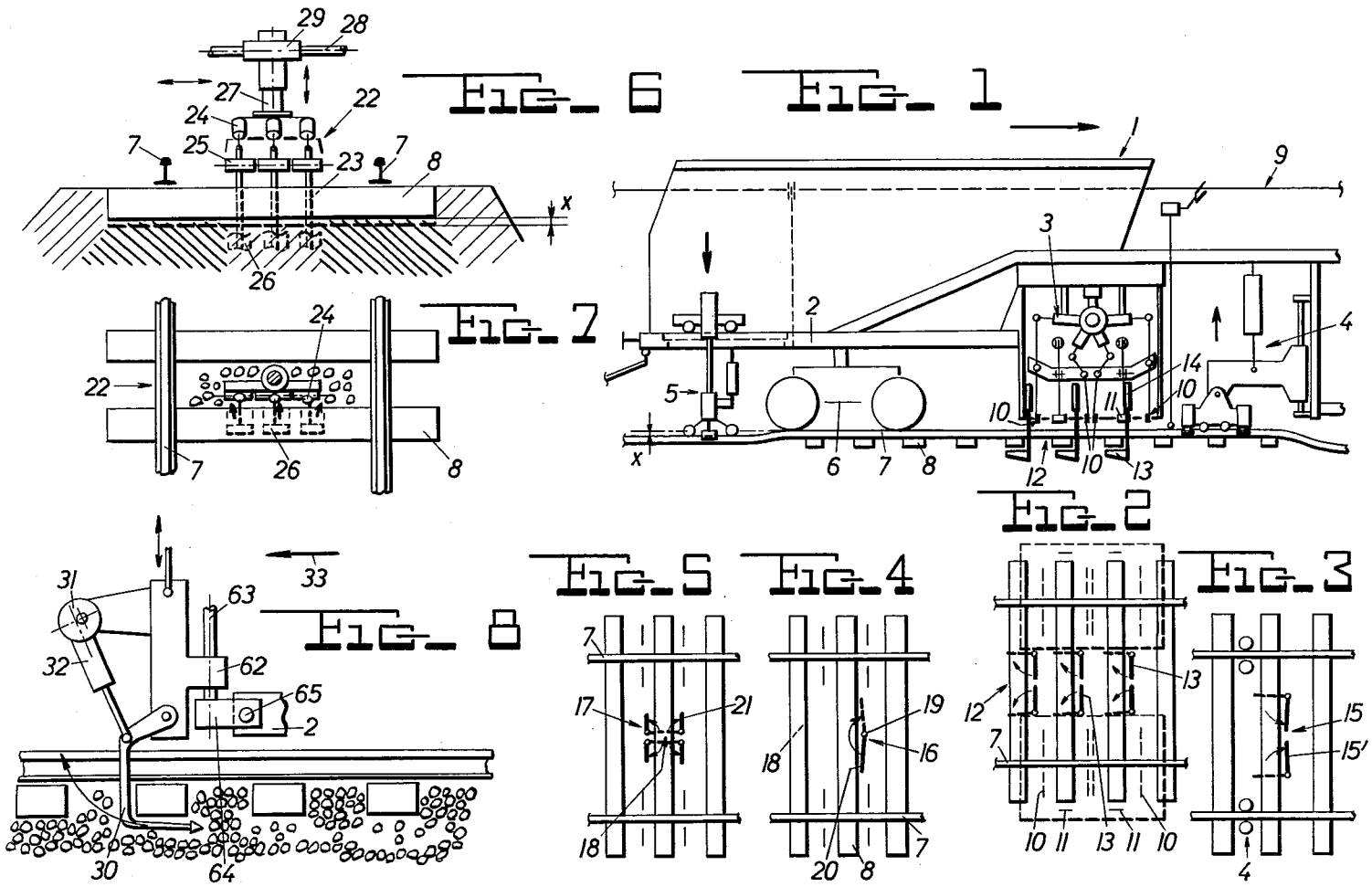
FIG. 2 is a schematic top view of the track in the region of the tamping tools and the associated ballast removing tools.
FIG. 3 is a view similar to that of FIG. 2, showing a modification of the ballast removing means arrangement.
FIGS. 4 and 5 are like views illustrating further modifications of the ballast removing tools.
FIG. 6 is an end view of another embodiment of ballast removing tools, seen in the direction of track elongation, the different densities of the ballast regions under the tie being indicated.
FIG. 7 is a top view of FIG. 6.
FIG. 8 is a side elevational view of yet another embodiment of a ballast removing tool connected to a vibratory drive.

Referring now to the drawing and first to FIG. 1, there is shown a combined track tamping, leveling and lining machine 1 mounted for mobility on track rails 7, 7 fastened to ties 8 resting on ballast (not shown), adjacent ones of ties 8 defining cribs therebetween. The machine comprises frame 2 carried by undercarriages 6 which move the machine along the track in the direction of the horizontal arrow shown in FIG. 1. The machine frame supports tamping tool unit 3, track leveling and lining unit 4 and dynamic track stabilization unit 5. A reference system 9 is associated with the track leveling and lining unit for controlling the track leveling operation. The illustrated track tamping unit comprises a pair of reciprocating vibratory ballast tamping tools 10 associated with each of the track rails for immersion of a respective tool 10 alongside the longitudinal edges of respective ties 8, with the ties between the pairs of tools and the tools arranged to reciprocate towards and away from the longitudinal tie edges, and a pair of additional reciprocating vibratory tamping tools 11 arranged for immersion of a respective tool 11 alongside a respective end of a respective tie 8, with the tie between the pair of tools 8 and the tools arranged to reciprocate towards and away from the tie ends. All of this structure is conventional and has, therefore, been described and illustrated only sketchily to avoid prolixity.

According to the invention, machine frame 2 also supports means 12 which adapts the machine to a method of surfacing the track by not only tamping ballast under the ties at the points of intersection with the rails but also removing ballast from underneath the ties between these points of intersection preferably simultaneously with, but no later than, the tamping of the ballast. In the embodiment of FIG. 2, the means 12 comprises ballast removing tools 13 arranged between the pair of tamping tools 10 and 11. In the modified arrangement of FIG. 3, which may be used in the machine shown in FIG. 1 instead of the tools 13, the means 15 for removing the ballast comprises ballast removing tools 15' arranged, like tools 13, in the region of a center line extending parallel to and between track rails 7, 7 and spaced from tamping tools 10, 11 forwardly in the direction of movement of the machine, tools 15' being shown to be mounted ahead of the track leveling and lining unit 4. Either arrangement of the ballast removing tools makes a rational treatment of the ballast possible so that the tamped ballast regions are not disturbed after tamping by the operation of the ballast removing tools.

In the embodiment of FIG. 2, the tamping tool unit 3 is of the known type permitting a number, i.e. three, of ties 8 to be tamped simultaneously by coordinated pairs of tamping tools 10, and a corresponding number of ballast removing tools 13 is mounted on machine frame 2 for independent vertical reciprocation, the tools 13 being arranged for immersion in succeeding cribs forwardly of the three ties to be tamped. Hydraulic drive 14 is associated with each tool 13 for vertically reciprocating the tool for immersion in the ballast.

In the modifications of FIGS. 2 and 3, the ballast removing tools comprise plate-shaped elements pivotal about a substantially vertical axis, two of such plate-shaped elements being spaced from each other along the length of the crib in which they are immersed and each element being pivotal in the direction of the intersection between tie 8 and a respective track rail 7 from the rest position shown in full lines in FIGS. 2 and 3 to the ballast removing end position shown in broken lines. All the tamping tool elements are pivotal in unison to remove ballast from the center region and simultaneously to move the removed ballast to the intersections between tie 8 and rails 7 whereby the ballast tamping effect of tamping tools 10 and 11 is enhanced.

While the plate-shaped ballast removing tool elements may be ram-like members thrust into the ballast, resistance to their immersion into the ballast and their pivotal movement in the ballast may be reduced by using sinuously shaped plates or fork-shaped members.

By arranging the ballast removing tools 15' in the region of track leveling unit 4, it is possible to remove ballast from the center region of the ties where it may have been compacted during the preceding tamping operation. In the arrangement of FIG. 2, on the other hand, ballast removing tools 13 are arranged in the region of the tamping unit but ballast removal is effected before tamping to prevent ballast pressed towards the center during tamping from interfering with the ballast removal. However, if the ballast removing tools are constituted as ballast tamping tools, tamping of the ballast under the outer regions of the ties and removal of ballast from under the center region of the ties are preferably effected simultaneously.

The pivotal ballast removing plate-shaped elements shown in FIGS. 2 and 3 by way of example have considerable advantages because they may be readily built into conventional machines of this general type and take up very little space, and such tools may be readily connected to the existing reciprocating drives for the tamping tools for pivoting them.

FIGS. 4 and 5 illustrate further modification of ballast removing tool elements of a type similar to that of FIGS. 2 and 3 but somewhat differently arranged.

The ballast removing means 16 of FIG. 4 consists of a single element 20 pivotal about vertical axis 19 by almost 180° from its rest position shown in full lines into its operational end position shown in broken lines, element 20 passing through center region 18 under tie 8 during its pivotal movement to sweep ballast from this region.

To reduce the force required for pivoting the ballast removing element immersed in the ballast, ballast removing means 17 of FIG. 5 is shown to comprise four elements 21 pivotal about a vertical axis from a rest position substantially parallel to the ties of an operative end position substantially parallel to the rails. As the elements 21 are swung back into their rest position, they will sweep ballast from region 18. Instead of pivoting elements 21 back into their rest position, they may be pushed transversely to the track when they have been pivoted into the position shown in broken lines whereby ballast will be removed from region 18 towards the intersections of rails 7 and tie 8. The length of elements 21 is reduced and such an arrangement will be particularly useful in tracks with narrow cribs.

To adapt the ballast removing means to different track configurations and, more particularly, to non-uniform crib widths, means 12, 15, 16 and 17 may be mounted on machine frame 2 for moving in the direction of, and/or transversely to, the track. It may also be useful to couple the ballast removing tools to vibrating drives to facilitate their immersion in the ballast and pivoting movement therein.

FIG. 1 schematically indicates the level of track rails 7 which are lifted to the desired level by unit 4 during a track surfacing operation, whereupon tamping tools 10 and 11 are operated to tamp the ballast under the ties at the intersections of ties 8 and rails 7 while ballast is removed from under the ties intermediate the rails by removing means 12. Subsequently, dynamic stabilization of the corrected track is produced by unit 5 which simultaneously vibrates the track in a horizontal and vertical direction to settle the corrected track by distance $x$. In this settling stage, it is advantageous that only the tie supports at the intersections with the rails are treated while the loosened or removed ballast at the center is not compacted during the settling of the track.

The embodiment of FIGS. 6 and 7 shows ballast removing means 22 comprising elements 23 pivotal about axis 25 substantially parallel to ties 8 and vertically reciprocably arranged for immersion in a crib adjacent tie 8. Three bell-crank tools 23 are provided in the illustrated embodiment and each tool is pivotal about axis 25 by hydraulic motor 24 associated therewith. The tools carry sinuously shaped plates 26 known for use in tamping tools and which will penetrate into the ballast more readily. A common hydraulic motor 27 is arranged for vertical reciprocation of the ballast removing tools and the entire removing means 22 is pivotal about shaft 28 extending transversely to the track, a drive 29 being provided for pivoting means 22 about axle 28 in the direction of track elongation. This arrangement is designed to fullfil the primary object of the present invention, i.e. the removal of ballast from under the ties intermediate the rails. Operation of ballast removing means 22 will move the ballast from under the ties to the adjacent cribs and this embodiment will, therefore, be particularly useful in track where it is desired to fill up the cribs with more ballast.

In operation, drive 29 will pivot means 22 about axle 28 into the position shown in FIG. 7, wherein the tool plates 26 extend below the adjacent tie 8, whereupon drives 24 are actuated to pivot tools 23 outwardly in the direction of track elongation so that the tool plates will move the ballast engaged thereby into the adjacent crib. Depending on the amount of ballast to be removed from under the tie into the crib, tools 23 are pivoted through a larger or smaller angle. The operation of tools 23 will be facilitated if a vibrating pressure fluid is delivered to motors 24 so that the pivoting tools are simultaneously vibrated.

FIG. 6 shows the ballast density conditions by different hatchings, the density of the ballast in the central region treated by tools 23 being much less than in the end regions under the rails 7 even after the track has settled by distance *x*.

In the embodiment of FIG. 8, ballast removing tool 30 comprises a bell crank lever one of whose ends is linked to tool carrier 62 which is mounted for vertical reciprocation on guide column 63. The guide column is carried by bracket 64 which is mounted on guide rod 65 affixed to machine frame 2 for movement of the guide column transverse of the track. In this manner, the ballast removing tool is mounted for movement vertical and transverse to the track. The bell crank lever part of ballast removing tool 30 is linked intermediate its ends to the piston rod of drive 32 while its cylinder is mounted on vertically movable tool carrier 62 by means of eccenter drive 31. In this manner, the tool may be pivoted about a horizontal axis through a path indicated by an arcuate arrow, the ballast removing portion of tool 30 consisting of a ram-like thrust element which may be pushed into the ballast under the tie to loosen the ballast and remove it into the next adjacent crib in a direction opposite to the direction of movement of the machine indicated by horizontal arrow 33. The thrust element may have a plurality of tines to operate in the manner of a fork to remove ballast over a desired width.

Imparting vibration to the ballast removing tools will greatly increase their ability to enter the ballast, to loosen and move it, and finally to compact the removed ballast at a point to which it has been moved. While an eccenter rotary drive for vibrating tool 30 has been illustrated in FIG. 8, any suitable vibrating drive, such as hydraulic pulse generators, may be used. Since vibrating drives are provided for the tamping tools, the ballast removing tools may simply be suitably coupled to such drives for vibration.

Also, while a hydraulic motor drive for pivoting the ballast removing tools has been illustrated, mechanical drives, such as a spindle-and-nut drive may be used for moving the ballast removing tools into and out of their operating positions if construction requirements indicate a preference for such mechanical drives. Various combinations of different drives for effectuating various movements of the tools are possible and use may advantageously be made of existing drives to which the ballast removing tools may be coupled.

Figure 9:
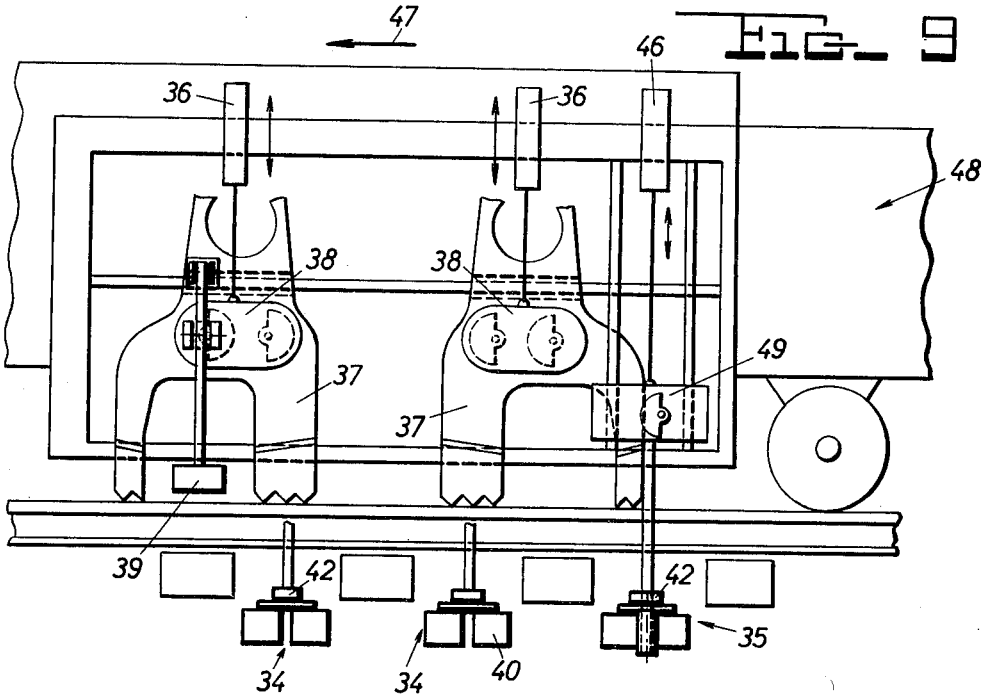
FIGS. 9 and 10 are, respectively, side elevational and top views of an embodiment of the ballast removing tools serving also as ballast compacting tools.
Figure 10:
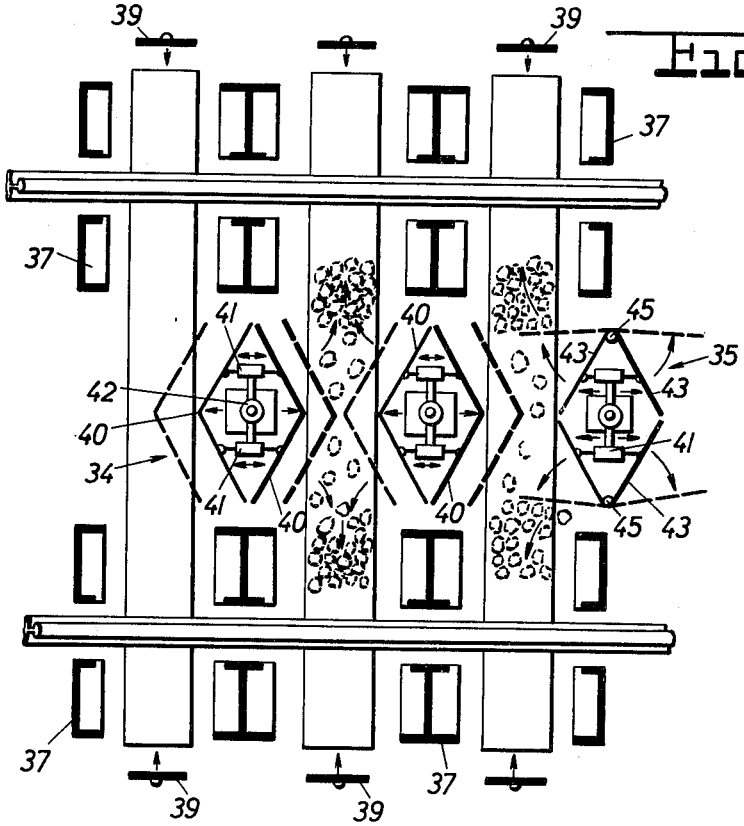

FIGS. 9 and 10 show ballast removing means 34 and 35 which are particularly useful in combination with the type of ballast tamping tools which are immersed into the cribs adjacent a tie and are then operated to push ballast under the ties not only at the points of intersection of the ties and rails but also in the center region of the ties, as disclosed in German Pat. No. 1,807,156 (U.S. Pat. No. 3,828,679, dated Aug. 13, 1974). To prevent the compaction of ballast under the ties in the region intermediate the rails, which is undersirable, ballast removing means 35 and 34 are designed not only to remove the ballast from the intermediate region but also to move the removed ballast towards the intersection points where compaction of the ballast is desired.

FIG. 9 diagrammatically shows a mobile tamping machine similar to that of the indicated patent, comprising machine frame 48 moving on the track in the direction of arrow 47 and carrying ballast tamping tools 37 vertically reciprocably mounted on the machine frame. Drives 36 are connected to the tamping tools to immerse them into the cribs, with a tie positioned therebetween, and vibrating drives 38 vibrate the tamping tools when they are immersed in the ballast to facilitate the displacement of the ballast from the cribs under the adjacent ties. In addition, tamping tools 39 are arranged for immersion in the ballast adjacent the ends of the ties and reciprocable in the direction of the ties to tamp ballast in the direction of the points of intersection of the ties and rails in a manner also well known.

If the above-described tamping tool arrangement is operated without ballast removing means, ballast will be tamped along the entire length of the ties, including the center region thereof. To avoid the latter, undersirable ballast compaction, ballast removing means 34 and/or 35 are mounted on the machine frame in associateion with the tamping tools. As best shown in FIG. 10, the ballast removing means are so arranged that, in cooperation with tamping tools 39, they will execute a pincer movement which considerably enhances the compaction of ballast in the desired regions, i.e. where the track rails rest on the ties.

Ballast removing means 34 comprises a pair of symmetrically arranged, substantially V-shaped elements 40 enclosing an obtuse angle whose apex is located substantially in the center line of the track. The two ballast removing elements are affixed to a pair of double-acting drives 41 arranged symmetrically in respect to the center line for moving the immersed V-shaped elements apart in the direction of track elongation, i.e. to move from the position in the crib shown in full lines to a position under the adjacent ties shown in broken lines wherein ballast is moved away from the center region towards the intersections between the ties and the track rails. The drives 41 are mounted on carrier 42 connected to drive 46 for vertically reciprocating the ballast removing means for immersion into the crib ballast.

In the modified ballast removing means 35, the two symmetrically arranged V-shaped tool elements each comprise a pair of members 43 which are pivotal about vertical axes 45 for moving the ballast from the center region towards the intersections, i.e. from the position shown in full lines to the position shown in broken lines and along the path of the arcuate arrows. Drives 41 are arranged to pivot members 43 and are mounted on carrier 42 which is vertically reciprocable by drive 46. Vibrating drive 49 is arranged to vibrate tool carrier 42 so that the ballast removing tools are vibrated while they execute their pivoting movement.

The ballast removing arrangements of FIGS. 9 and 10 are very effective not only in removing ballast from the center region of the ties but also to enhance the compaction of the ballast at the end regions thereof and thus to prevent riding of the ties.

Figure 11:
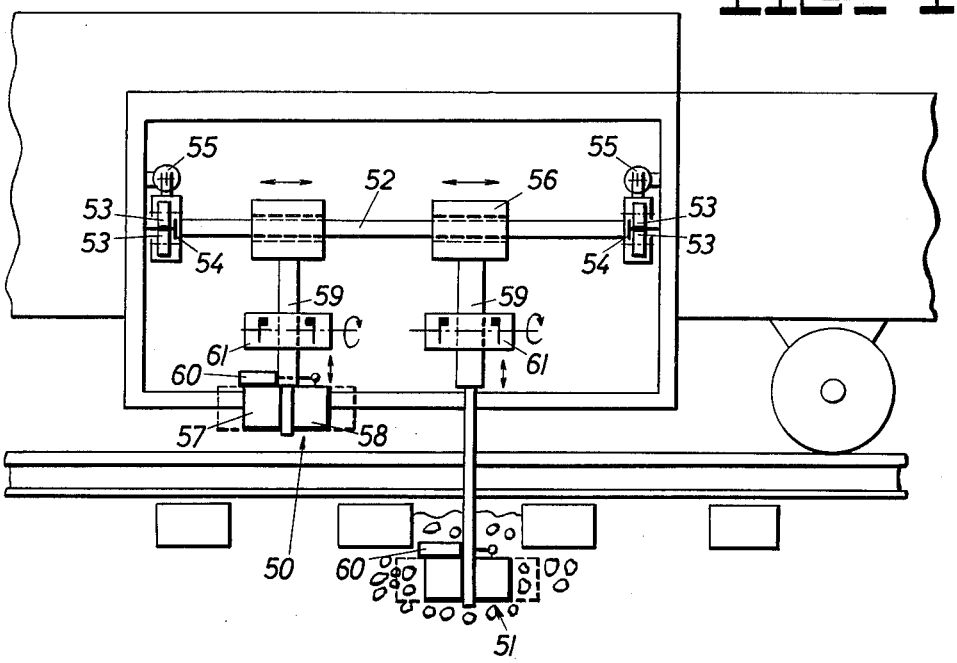
FIGS. 11 and 12 are, respectively, side elevational and top views of yet another embodiment of combined ballast removing and compacting tools.
Figure 12:
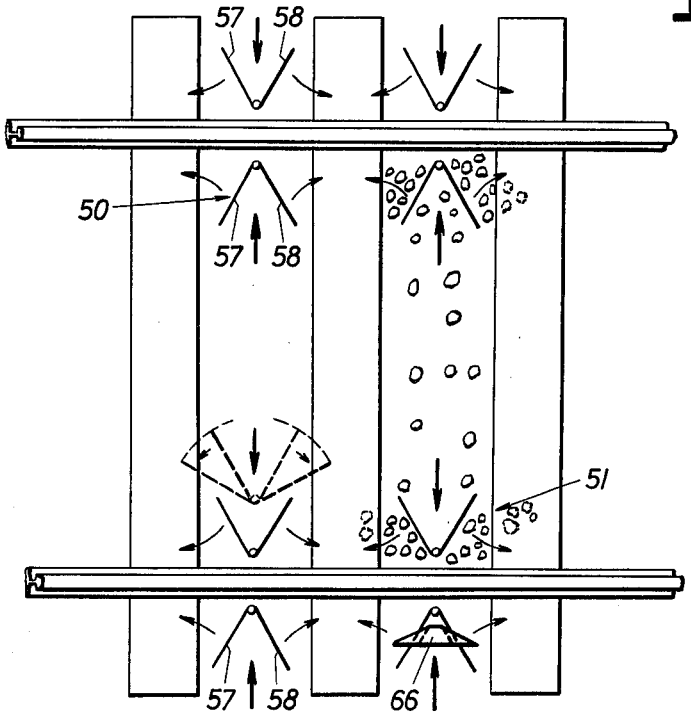

In the embodiment of FIGS. 11 and 12, the ballast removing means 50 and 51 have tools arranged to operate not only to remove ballast from under the ties at the center region thereof but simultaneously to press the removed ballast under the ties transversely outwardly toward their intersections with the rails.

In the illustrated arrangement, guide rod 52 extending in the direction of track elongation is mounted on the frame of the mobile tamping machine to carry ballast removing means 50 and 51 longitudinally reciprocably on the rod for movement in the direction of the track. The ballast removing means are mounted on the guide rod by bushings 56 which may be glidably mounted on guide rod 52, with suitable drives (not shown) for moving the bushings along the rod, or the guide rod may be a spindle having threaded portions meshing with internal threads in bushings 56 for moving the bushings in the track direction upon rotation of spindle 52. Furthermore, ballast removing means 50 and 51 may be moved transversely of the track by mounting the ends of guide rod 52 on rollers traveling on transverse rails 54, 54 mounted on the machine frame. Hydraulic drives 55, 55 are arranged on the frame for moving guide rod 52 and, with it, the ballast removing means in a transverse direction.

The tools of the ballast removing means are similar to those of ballast removing means 35 described hereinabove, each tool comprising a V-shaped tool element comprised of a pair of plate members 57, 58 pivotal about vertical axes for moving the ballast from the center region towards the intersections as the tools are immersed into a crib in the center region of the ballast bed, the tool members are spread apart to engage ballast under the adjacent ties in the center region, and the tools are transversely moved towards the respective rails by motors 55, as shown in FIG. 12. Drives 59 mount the tools on bushings 56 for vertical reciprocation and immersion of the tools in the ballast and drives 60 are connected to plate members 57, 58 to spread the same and pivot them back into their inoperative position, the angle between the plates of each pair being controlled by drive 60.

The ballast removing tools cooperate with like tools mounted outside the track rails, as shown in FIG. 12, for compacting the ballast between the outwardly moving means 50 and 51, and the outer tamping tools, the pincer movement between these tools enchancing the tie tamping at the intersections of the ties and rails.

As shown in connection with one of the tools in FIG. 12, drive 60 for spreading the tool members to enclose desired angles may be replaced by a wedge-shaped spreading tool 66 which may be moved vertically between pivotal tool members 57, 58 to spread them apart. Also, instead of providing V-shaped tool elements comprised of two pivotal members, a unitary V-shaped tool element like that shown at 40 in FIG. 10 may be used. Furthermore, as shown, vibrators 61 are arranged to vibrate the tools.

It will be understood that various embodiments of the hereinabove described and illustrated tools may be used inter-changeably and in combination, many of these tools in appropriate arrangements being useful as ballast removing and ballast compacting tools. Furthermore, the ballast removing tools may be combined suitably with other tamping tools and/or with tools for effecting dynamic track stabilization. More particularly, they may be used not only in otherwise conventional track tamping machines or combined track tamping, leveling and lining machines but also in other track surfacing apparatus, such as ballast cleaning machines or mobile track renewal machines, the object being in all track maintenance machinery to avoid the creation of compacted ballast zones in the center region of the track ties since this condition produces undesirable tie riding.

What is claimed is:

1. A mobile machine for tamping ballast under ties supporting rails of a track, adjacent ones of the ties defining cribs therebetween and the rails intersecting the ties at respective points of intersection, which comprises the combination of 1. vibratory ballast tamping tools arranged to tamp ballast under the ties at the points of intersection and
2. means for removing at least a portion of the ballast from a region below the ties intermediate the track rails, the ballast removing means including a. ballast removing tools associated with the tamping tools,

2. The mobile ballast tamping machine of claim 1, wherein the ballast removing tools are arranged to move the ballast from the intermediate region towards the point of intersection to compact the ballast thereat.

3. The mobile ballast tamping machine of claim 1, further comprising means for reciprocating the vibratory ballast tamping tools towards and away from respective ones of the ties.

4. The mobile ballast tamping machine of claim 3, wherein a pair of the reciprocating vibratory ballast tamping tools is associated with each of the track rails for immersion of a respective one of the tools alongside the longitudinal edges of a respective one of the ties, with the one tie between the pairs of tools and the tools being arranged to reciprocate towards and away from the longitudinal tie edges, and the ballast removing tools are arranged between the pairs of tamping tools.

5. The mobile ballast tamping machine of claim 3, wherein a pair of the reciprocating vibratory ballast tamping tools is arranged for immersion of a respective one of the tools alongside a respective end of a respective one of the ties, with the one tie between the pair of tools and the tools being arranged to reciprocate towards and away from the tie ends, and the ballast removing tools are arranged between the pair of tamping tools.

6. The mobile ballast tamping machine of claim 1, wherein the ballast removing tools are arranged in the region of a center line extending parallel to and between the track rails, and spaced from the tamping tools forwardly in the direction of movement of the machine.

7. The mobile ballast tamping machine of claim 1, wherein the ballast removing tools comprise plate-shaped elements pivotal about a substantially vertical axis and arranged for immersion in a crib adjacent a respective one of the ties.

8. The mobile ballast tamping machine of claim 7, further comprising hydraulic drive means for vertically reciprocating the ballast removing tools for said immersion.

9. The mobile ballast tamping machine of claim 7, comprising two of said pivotal plate-shaped elements mounted for immersion in the crib and spaced from each other along the length of the crib, each of the elements being pivotal in the direction of the intersection between the one tie and a respective one of the track rails.

10. The mobile ballast tamping machine of claim 1, wherein the ballast removing tools comprise elements pivotal about an axis substantially parallel to the ties and vertically reciprocably arranged for immersion in a crib adjacent a respective one of the ties.

11. The mobile ballast tamping machine of claim 10, wherein the elements are fork-shaped members.

12. The mobile ballast tamping machine of claim 10, wherein the elements are ram-like members.

13. The mobile ballast tamping machine of claim 1, wherein each ballast removing means comprises a plurality of the ballast removing tools.

14. The mobile ballast tamping machine of claim 13, wherein the number of the ballast removing tools corresponds to the number of ties to be tamped simultaneously by the tamping tools, each of the ballast removing tools being independently vertically reciprocable and all of the ballast removing tools being pivotal in unison.

15. The mobile ballast tamping machine of claim 1, wherein the ballast removing tools comprise substantially V-shaped elements arranged for immersion in the cribs and drive means for moving the immersed V-shaped elements in a direction to move ballast towards the intersections between a respective one of the ties and a respective one of the track rails.

16. The mobile ballast tamping machine of claim 15, wherein the V-shaped elements comprise a pair of members pivotal for moving the ballast towards the intersections.

17. The mobile ballast tamping machine of claim 16, comprising four of said V-shaped elements for immersion in each of the cribs, respective pairs of the V-shaped elements being associated with each track rail and the members of said elements being pivotal for moving the ballast towards the intersections of the one tie with the associated rail.

18. A method of surfacing a track comprising two rails fastened to ties resting on ballast, each tie intersecting the rails at two points spaced transversely of the track and adjacent ones of the ties defining cribs therebetween, which method comprises the steps of 1. tamping ballast under the ties at the points of intersection between the ties and rails, and
2. removing ballast from underneath the ties between the points of intersection no later than the tamping of the ballast.

19. The track surfacing method of claim 18, wherein the ballast is tamped at the points of intersection after the ballast is removed between the points of intersection.

20. The track surfacing method of claim 18, wherein the ballast is tamped at the points of intersection substantially simultaneously with the removal of the ballast between the points of intersection.

21. The track surfacing method of claim 18, wherein the ballast is removed from underneath each of the ties between the points of intersection and the removed ballast is pressed transversely outwardly towards the two points of intersection while ballast is simultaneously pressed transversely inwardly against the two points of intersection to tamp the ballast at the points of intersection.

* * * * *